US010513391B1

(12) United States Patent
Sosan

(10) Patent No.: US 10,513,391 B1
(45) Date of Patent: Dec. 24, 2019

(54) METHOD AND APPARATUS FOR CLOSING SACKS AND BAGS

(71) Applicant: Folarin Sosan, Burtonsville, CA (US)

(72) Inventor: Folarin Sosan, Burtonsville, CA (US)

( * ) Notice: Subject to any disclaimer, the term of this patent is extended or adjusted under 35 U.S.C. 154(b) by 305 days.

(21) Appl. No.: 15/449,764

(22) Filed: Mar. 3, 2017

Related U.S. Application Data

(60) Provisional application No. 62/302,959, filed on Mar. 3, 2016, provisional application No. 62/436,962, filed on Dec. 20, 2016.

(51) Int. Cl.

| | |
|---|---|
| ***B65F 1/16*** | (2006.01) |
| ***B65D 65/46*** | (2006.01) |
| ***B65D 65/10*** | (2006.01) |
| ***B65D 33/28*** | (2006.01) |
| ***B65B 7/02*** | (2006.01) |
| ***B65B 67/06*** | (2006.01) |

(52) U.S. Cl.
CPC ..... *B65F 1/16* (2013.01); *B65B 7/02* (2013.01); *B65B 67/06* (2013.01); *B65D 33/28* (2013.01); *B65D 65/10* (2013.01); *B65D 65/466* (2013.01); *B65F 2250/105* (2013.01); *B65F 2250/108* (2013.01)

(58) Field of Classification Search
CPC ..... B65F 1/16; B65F 2250/105; B65F 2250/108; B65D 33/28; B65D 65/10; B65D 65/466; B65B 7/02; B65B 67/06
USPC ..... 383/78–81, 103, 118; 150/154–168; 229/87.01–91
See application file for complete search history.

(56) References Cited

U.S. PATENT DOCUMENTS

| | | | | |
|---|---|---|---|---|
| 2,394,335 A | | 2/1946 | Shapiro | |
| 3,016,131 A | * | 1/1962 | Kennedy | B65D 85/345 206/526 |
| 3,040,966 A | * | 6/1962 | Crane | B65D 29/04 383/103 |
| 3,040,968 A | * | 6/1962 | Long | B65D 65/38 229/87.08 |
| 3,186,626 A | | 6/1965 | Shvetz | |
| 3,245,606 A | * | 4/1966 | Crane | B65D 33/01 383/103 |
| 3,495,764 A | * | 2/1970 | Crane | B65D 33/01 383/103 |

(Continued)

*Primary Examiner* — Jes F Pascua

(57) ABSTRACT

A cover for use with sacks for covering the mouth of a sack after it has been filled, to prevent its contents from spilling. One application is for recyclable yard waste sacks that are used to carry yard waste such as leaves, or used for carrying food scraps from restaurants. The sacks being made of paper so that they can be composted, require a cover that is made of paper that can be recycled as well. Some embodiments of the cover utilized a paper with a plurality of holes or die-cut slits that stretch into a hexagonal three dimensional shape when pulled, and contracts when released. The unusual elasticity afforded to ordinary paper by the slit holes patterns is used to create a sack cover that can stretch to close a sack without tearing. The elasticity is utilized to create sufficient griping force on the mouth of the sack to resist dislodgement of the cover when the sack tips over. A few embodiments of the cover utilize a hybrid design in which both ordinary and slitted paper are used. Other embodiments of the cover are made of ordinary paper with a drawstring.

15 Claims, 7 Drawing Sheets

(56) References Cited

U.S. PATENT DOCUMENTS

| | | | | | |
|---|---|---|---|---|---|
| 4,615,671 | A * | 10/1986 | Bernal | B26F 1/18 | 264/146 |
| 4,832,228 | A * | 5/1989 | Hickey | A01K 31/007 | 119/174 |
| 4,856,140 | A * | 8/1989 | Visco | E03D 9/00 | 16/412 |
| 5,365,819 | A * | 11/1994 | Maida | B21D 31/04 | 493/363 |
| 5,667,135 | A * | 9/1997 | Schaefer | A47G 23/0216 | 220/738 |
| 5,667,871 | A * | 9/1997 | Goodrich | B31C 5/00 | 206/521 |
| 5,688,578 | A * | 11/1997 | Goodrich | B21D 31/04 | 206/521 |
| 7,051,895 | B2 * | 5/2006 | Toussant | B65D 41/22 | 150/154 |
| 9,963,283 | B2 * | 5/2018 | Page | B31D 5/0065 | |
| 10,226,907 | B2 * | 3/2019 | Goodrich | B32B 3/266 | |
| 2003/0215161 | A1 | 11/2003 | Rubman | | |
| 2004/0084460 | A1 * | 5/2004 | Scheetz, II | B65D 81/3879 | 220/739 |

* cited by examiner

METHOD AND APPARATUS FOR CLOSING SACKS AND BAGS

CROSS-REFERENCE

The present application claims the benefit of U.S. provisional application No. 62/302,959, filed on Mar. 3, 2016 and U.S. provisional application No. 62/436,962, filed on Dec. 20, 2016, which are incorporated herein by reference in its entirety.

BACKGROUND SECTION OF THE INVENTION

Many counties and states in the U.S. require that yard waste such as leaves and branches be disposed of in paper bags. The yard waste is put into large paper sacks which are collected by the state or private companies for use as compost. Because the sacks are composted with the yard waste, the sacks have to be made of recyclable materials. Many counties prohibit the use of, or addition to the sack, of materials that cannot be composted. As such plastics are usually prohibited from being part of the bag or its contents.

After filling with yard waste the bags are usually stood up to be stored. Bags that are full of leaves are difficult to close. Closing the bags usually means that the top of the bag is folded which means that the bags are not completely filled and the sacks are underutilized. Since the bags are purchased this leads to wastage of money. When bags are filled or during filling, they often tip over causing the person filling the sack to refill them. Bags have to be handled carefully to avoid tipping. When they are stored upright they often tip over e.g. by the wind, creating an untidy heap that must be cleaned up. Without a secure cover, the contents of the sack are easily spilled.

Another potential problem with a sack that is not properly sealed is that wildlife such as snakes, rodents, insects, or spiders may enter the sack to hide among the leaves. These wildlife can pose a hazard to workers when they collect the sacks, or to the home owners who move the sacks from storage to the collection site. Millions of recyclable yard waste sacks are produced every year. The sacks have no provision for closing them to prevent spillage of their contents or entry of wildlife or insects. The equipment used for producing these sacks is expensive and making modifications to the sacks to include a cover would be expensive. Accordingly a need exists for a cover made of a recyclable material which can fit over existing recyclable sacks without requiring modifications to existing sacks.

U.S. Pat. No. 2,394,335 to Shaipro discloses a double walled sack with an adhesive used to glue inner walls together after the insertion of trash, and a flap used to further bind the combination together. This arrangement is complicated and would be difficult to manufacture. It would also be expensive. The covers are integral with the sack and the patent does not disclose a cover for closing an open end of an existing open mouthed sack. U.S. Patent application No. 2003/0215161A1 discloses a sack with a relatively small hole for depositing trash. The hole has an elastic member in its periphery that keeps it partially closed. The hole is preferably stretched to permit entry of trash into the sack after which it will partially close. The sack is thus always partially open. The parts of the sack that permit its closure are integral to the sack as a whole and cannot serve to close the open mouth of an existing separate sack.

U.S. Pat. No. 3,186,626 to Shevetz discloses a sack with tearable strips which can be ripped from the body of the sack and used to tie off its mouth. Trash bags are made of cheap paper like craft paper which is rough. If made of paper, experience has shown that paper strips do not develop strong tension when tied in a knot. The coefficient of friction is high and the paper-on-paper contact does permit strong tension to be developed in the paper strips. If the paper is strong, the strips will not develop sufficient tension to close the sack tightly owing to the restriction caused by the knot. If the paper is pliant the paper is prone to tearing. In either case it will not result in a tightly closed sack. The method also does not allow the full capacity of the sack to be used because a portion of the sack must be left unused to free up material that can be tied. The sack will also be difficult to manufacture as currently sack are made from paper roll or sheets with no provision for tearable strips.

While sacks with drawstrings at their mouths exists as disclosed in U.S. Pat publication US 2011/0002559A1 to Wood et Al, the drawstrings form closure of the sacks that are integral with the sacks and not accessories for closing other existing open mouthed sacks. Sacks with drawstrings are usually made of plastic because of standard existing manufacturing methods to incorporate plastic drawstrings in plastic sacks. The embodiments included in this specification include features to simplify the manufacture of such sacks such as a separate paper strip for attaching the string to the sack.

SUMMARY SECTION OF THE INVENTION

A solution to the problem of the bags tipping over and the leaves spilling is to use a cover which is made of a stretchable material to cover the opening of the sack. By being able to stretch, the cover will be easier to fit on a yard waste sack than one which cannot stretch. Covers or caps made of ordinary paper tend to tear when fitted over a full sack. They then becomes loose and fall off easily. If made of an elastic material the cover will fit tightly around the sides of the sack and resist dislodgement when the sack tips over. Ideally the cover should be made of a recyclable material like paper. A material that fits this requirement is a die-cut paper with hexagonal slits that that expands into a three dimensional honeycomb structure when pulled. The paper has an array of die-cut hexagonal slits which are in a repeating pattern having regular spaces between them. The pattern of slits in any particular row is offset from a neighboring row so that the slits of one row are approximately centered on the spaces in the slits in an adjacent row. Accordingly sheets of this type of paper can be described as having a plurality of slits in a pattern of spaced parallel rows of individual slits, each of said rows having interval spaces between consecutive slits, each slit configured to form one opening upon expansion When a force is exerted on a sheet of such paper in such a way that the paper is pulled in a direction substantially perpendicular to the line that comprises the closed slits, the array of slits open and the paper forms a three dimensional honeycomb structure. When this happens each slit opens up to a maximum of approximately one centimeter wide around their centers and the sheet stretches considerably in the direction that the slits open. The thickness of the resulting structure is several times that of the original paper e.g. more than five times the original thickness. A fully expanded sheet can easily extend 50% in length when under tension but contract about 25% of original length after the force that expanded it has been removed. The significant contraction after being expanded is unique to this type of paper and this property is utilized in this invention. This paper is known as Geami paper and is marketed by RanPak Corporation of Concord Township Ohio. Another manufacturer of this type of paper is GC Technologies LLC of Newtown, Conn., where it is called Hexcelwrap. Geami paper or Hexcelwrap is sold in expanded or unexpanded form. It is used as packaging for the safe conveyance of goods by cushioning them from damage by impact, shock, or vibration during transit. It is advertised as being an environmentally friendly substitute for plastic bubble wrap and foam packaging.

In the expanded form the paper has been stretched so that the paper sheets assume a honeycomb structure as the holes in the paper expand. Geami paper is also sold as unexpanded paper where the honeycomb holes that have been cut in the paper remain slits of approximately one centimeter in length with no significant widths, being essentially straight lines in the paper. The sheets can be pulled on a machine prior to use to expand them. In the flat or unexpanded form the paper has significant elasticity and will attempt to regain its original size when pulled. It is able to stretch more than a similar piece of expanded paper. A cover in the shape of a grocery sack can be shaped from this paper. Expanding the paper cover is done by pulling the sides of the cover in opposing directions. One method is to put one's hands into the cover and pull the sides of the cover outward. The object is to expand the sack so that its opening barely fits the mouth of the yard waste sack so that the cover will fit tightly around the sides of the yard waste sack, capping off its contents. Yard waste sacks often come in a standard size of 30 gallons. When filled with leaves the sacks become approximately cylindrical in shape with a diameter of approximately forty centimeters. When the slitted paper is formed into a pinched bottom sack, it may have a width of about 15 inches not counting gussets, and a length of similar dimensions. However different dimensions are possible and those provided are for reference only.

Making the cover with unexpanded paper has a number of advantages. First in its flat, unexpanded state the paper sheet is easy to make into a cover shaped like a sack especially when glue is used. The holes in expanded paper make it difficult to glue. Secondly the sack can be expanded incompletely, leaving portions of it substantially unexpanded so as to maintain as much elasticity as possible. While the cover can be made of expanded Geami paper, the expanded paper while still elastic, does not have the same elasticity as paper that is incompletely expanded having a significant number of holes that have not fully opened. Besides allowing the cover to fit more tightly around the sides of the yard waste sack, the paper that is not fully expanded stretches more and is less prone to tearing when fitting the cover on a sack Geami paper stretches mostly in one direction—the direction that causes the slitted holes to open up into a hexagonal honeycomb structure. When used as a covering material for a sack, or when shaped into a sack, the direction of orientation of the slits is the direction that expands the girth of the covering means or sack. For example if the paper sack that comprises the cover is stood up vertically so that its closed end faces upward and it rests on its open end, in the unexpanded state of the paper, the slits will appear as vertical lines. The slits will then open substantially horizontally when the paper is expanded e.g. by pulling the sides of the sack horizontally in opposing directions, allowing the girth of the cover to increase.

Besides using Geami paper to make a stretchable cover for yard waste sacks, stretchable covers can also be made of woven or knitted recyclable materials like paper or other natural fibers such as cotton based cloth, or nets made of cotton or jute etc.

The cover or sack can also be made of ordinary paper or Kraft paper or other paper which does not stretch significantly. Some means of causing a closure of such sacks will have to be added. These means may include a drawstring or adding portions of elastic material such as the expandable paper with an array of slits. The cover in the shape of a sack may be used to close off a variety of sacks including yard waste sacks, grocery bags, grocery sacks or any open receptacle made of any material including plastic and metal. Grocery sacks can be closed off with the paper cover after shopping to prevent their contents from spilling out. Similarly barrels or other receptacles containing items like food can be closed with the cover. The invention can also be used to close trash bags, e.g. a trash bag that has been overfilled and whose end can no longer be tied off, or closed with a drawstring.

Provided is a cover for a sack comprising a closed and an open end, the cover comprising of a biodegradable material having an un-expanded position and an expanded position, the material configured to form an array of openings in the expanded position, wherein the cover is deployed on the sack at the open end; and wherein the sides of the cover in proximity to the open end grip the sack and allow the cover to close the sack and prevent content of the sack from spilling. The sheet of material that the cover can be made from becomes longer when a force is applied to pull the material in a way that opens the array of openings, and becomes shorter when the force is removed, such that when the open end of the cover is expanded by pulling, and deployed over the mouth of a sack and then released, the sides of the cover in proximity to the open end of the cover grip the sack allowing the cover to close the sack, preventing the contents of the sack from spilling. The cover comprises one or more paper sheets having a plurality of slits in a pattern of spaced parallel rows of individual slits, each of said rows having interval spaces between consecutive slits, each slit configured to form one opening upon expansion. The slits can extend in a direction of the open end to the closed end, and open in a substantially perpendicular direction. The slits in each row can be positioned adjacent the interval space between consecutive slits in a next adjacent parallel row of slits. The openings can be generally similar in shape and size, in a consistent, uniformly repeating opening pattern. The sheet can be made from non-woven fibrous material. In the un-expanded position the sheet can be flat and in the expanded position the sheet is a three dimensional honey comb structure. The sack can be a yard waste sack used for disposing of recyclable yard waste or food waste. The lower portion of the cover in proximity to its open end can be made from the material with the array of openings and an upper portion above the material lacking openings. The openings can be hexagonal. The cover can resume substantially its condition in the unexpanded position when a force applied to it in the deployed condition is removed. The material can be die cut paper that expands into a hexagonal honeycomb structure when pulled. The cover can be shaped into a pinched bottom sack with tapered sides ending in a ridge or line at the closed end. The cover can be formed into bag or sack with a rectangular bottom at the closed end. It can also be formed into a sack that tapers to a ridge or line at the closed end.

Provided is a cover for a sack comprising a closed and an open end, the cover made from a biodegradable material, the cover in form of a pinch bottom bag having an open end and a closed end, the cover further having a string and a one or more loops for passage of the string around the cover, wherein the cover is configured to be tightened around the sack at the open end with the string. The string can be biodegradable. Provided is a method of covering a sack with a cover comprising: a) expanding a cover comprised of a biodegradable material from an un-expanded position and an expanded position, the material configured to form an array of openings in the expanded position; b) positioning the cover on the sack at the open end; and c) releasing the cover, wherein the cover after being released contracts and grips the sack and prevent contents of the sack from spilling. Provided is a method of covering a sack with a cover comprising: a) expanding the cover made of the expandable paper having an array of hexagonal slits in regular repeating patterns that can open when the paper is pulled, causing the paper to stretch and increase its girth, such that the cover can be made substantially bigger when its sides are pulled away from each other, b) pulling the sides of paper cover to extend the size of its opening so that it is bigger than the opening of the sack, and positioning the open mouth of the cover over the sack at the open end; c) releasing the cover, wherein the cover after being released contracts and grips the sides of the sack and prevents the contents of the sack from spilling.

Provided is a method of securing the opening of a sack after it has been filled, by employing a material that is substantially elastic, forming it into a covering means having an open end for substantially engulfing the open mouth of the sack, and a constraining means for constraining the covering means to the sack so that it grips the sides of the sack, and a closed end that covers the open mouth of the sack and prevents its contents from spilling, wherein the constraining means comprises substantially of the elasticity of the material of the covering means and the stiffness afforded by the geometry of its construction. The covering means can be made substantially of paper with perforations or holes that open up and permit the paper to stretch when pulled, and contract substantially when released, thus making the paper significantly elastic. The flat unexpanded Geami paper can be used to make the covering means and prior to putting it over the sack, the flat Geami paper is pulled causing it to stretch substantially so as to expand a significant number of the holes or perforations but not all, so that it retains an ability to stretch further beyond what would be possible with expanded Geami paper in which the paper has been expanded substantially, thus being in a state of expansion intermediate between the flat or unexpanded paper, and the expanded paper. The covering means can be shaped into a pinched bottom sack having an open end, and a closed end with tapered sides ending in a ridge or line at the closed end. The covering means can be formed into a grocery or merchandise style bag with a rectangular bottom at the closed end. The covering means can be made substantially of knitted paper and the knitted paper stretches when pulled to fit over the mouth of the sack. The covering means can be formed into a pinched bottom sack. Provided is a method of closing the opening of a sack after it has been filled, by employing a material that is substantially flexible, forming it into a covering means having an open end for substantially engulfing the open mouth of the sack, and having a constraining means for constraining the covering means so that it grips the sides of the sack, and a closed end that covers the open mouth of the sack and prevents its contents from spilling. The covering means can be made of recyclable materials and the constraining means is a string made of recyclable materials that is housed within the covering means and substantially encloses the covering means so that when at least one end of the string is pulled, it constrains the covering means around the sack and effects a closure of the sack. The covering means can be a pinched bottom sack and the string runs along a periphery of its opening with both ends emerging from the sack close to each other. After using the pinched bottom paper sack that comprises the covering means to cover the mouth of a sack, the ends of the string are pulled tightly to effect a secure closure of the sack and tied in a knot to prevent loosening. At least one portion of the string passes through a hole in a collar or bushing attached to the paper sack so that it constricts the string, thus allowing the string to function as a noose that passes substantially around the opening of the first sack that comprises the covering means, and fastens it securely around the opening or mouth of a second sack effecting the closure of the second sack.

Provided is a cover for a sack having a closed end and an open end, the cover made from a biodegradable material having a pleated or corrugated configuration in its unexpanded form, the pleats being flexible and able to flatten and extend in response to an urging force acting to extend the material, and the cover shaped in form of a sack having at least one layer of expandable paper with an array of hexagonal slits attached to it in the proximity of its open end such that the expandable paper provides a counter force to resist an urging force that opens the cover and substantially reduces the opening of the cover when the urging force is removed.

A cover for a sack comprising a closed and an open end, the cover comprising of a biodegradable material having a first position and a second position, the material configured to form an array of openings at least in the second position, wherein the cover is deployed on the sack at the open end, and wherein sides of the cover in proximity to the open end grip the sack so that the cover forms a closure of the sack and prevent contents of the sack from spilling.

DETAILED DESCRIPTION OF THE INVENTION

Figure 1:
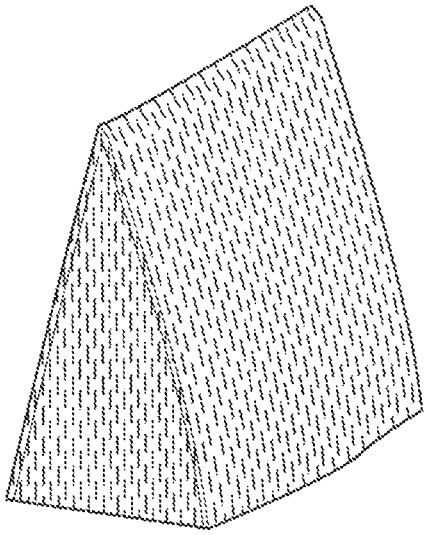
FIG. 1 is a perspective view of a pinched bottom sack made of expandable slitted paper prior to being expanded.
Figure 2:
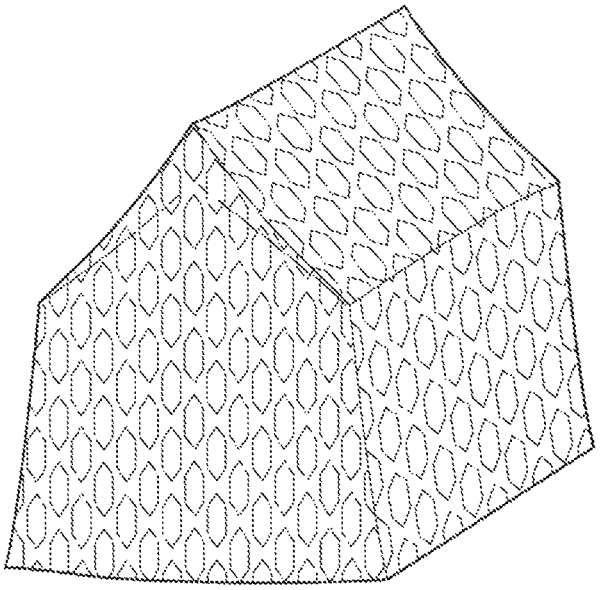
FIG. 2 is a perspective view of a pinched bottom that has been expanded by stretching the paper.

A first embodiment of the stretchable cover is shown in FIG. 1. Flat Geami paper has been shaped into a pinched bottom paper sack. One end of the sack is open while the other end is closed with the sides tapering to a line or ridge. The holes are substantially closed and appear as slits. As used here, the term expanded position refers to the condition of the paper where after it has been extended by a pulling force, where at least 25% of the slits or openings in the paper have increased in area to at least 25% of the area that each would have at maximum extension when the paper begins to tear. This expanded position is shown in FIG. 2. The term un-expanded refers to the paper with closed openings as shown in FIG. 1. Sheets of unexpanded paper are at nominal dimensions comparable to ordinary paper without slits. In another embodiment, sheets from the manufacturer are already in an expanded or semi-expanded state, and are further expanded when used to cover the sac.

FIG. 2 shows a pinched bottom sack made of Geami paper that has been expanded. The die cut holes in the paper have opened up allowing the paper to expand or stretch. In use the pinched bottom sack is put over the mouth of a yard waste sack like a wool knit cap on a person's head so that the closed end is at the top of the yard waste sack. Hence the pinched bottom sack forms a cap for the yard waste sack. The pinched bottom sack can then be called a cap.

Figure 3:
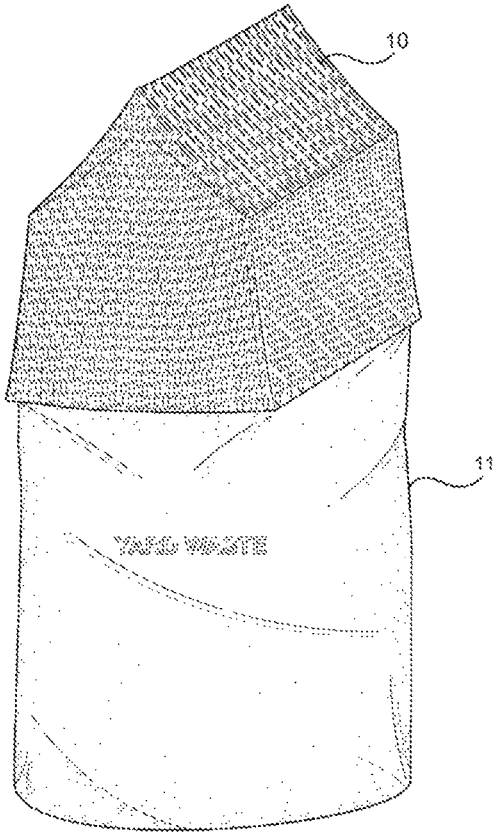
FIG. 3 is a perspective view of a Yard waste sack that has been closed with a pinched bottom sack made of slitted paper.

FIG. 3 shows a yard waste sack 11 that has been fitted with a cover 10 made of Geami paper in a pinched bottom sack design.

Figure 4:
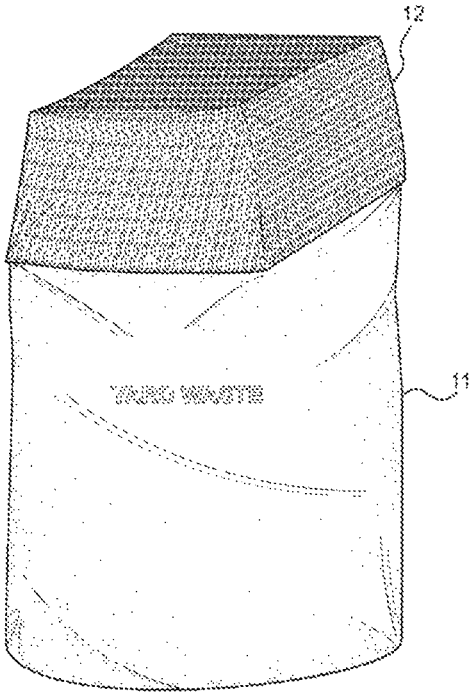
FIG. 4 is a perspective view of a Yard waste sack that has been closed with a rectangular bottom merchandise style sack made of slitted paper.

FIG. 4 shows a yard waste sack 11 that has been fitted with a cover 12 made from Geami paper in the design of an ordinary merchandise bag with a rectangular bottom.

Figure 5:
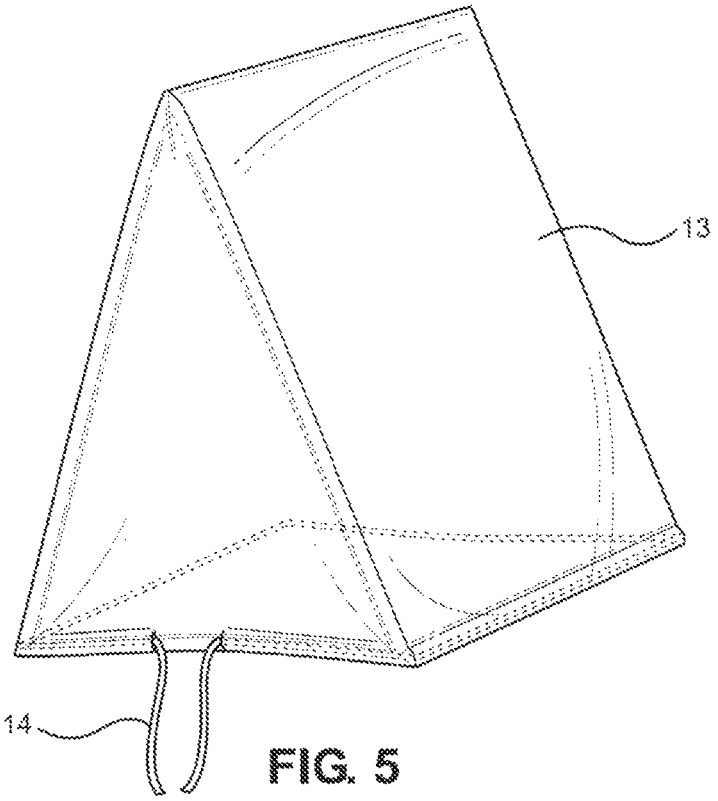
FIG. 5 is a perspective view of a pinched bottom sack made of ordinary paper with a drawstring around its opening.

FIG. 5 shows a pinched bottom sack 13 made or ordinary paper with a piece of string 14 attached to it along the periphery of the opening of the sack and is used to effect a closure of the sack. The string runs along the edge of the opening of the sack through an enclosure, channel, or loops inside the walls of the sack and its ends emerge together in front of the sack. The string is threaded through an enclosure within the walls of the sack and is preferably not sewn, or rigidly attached to the sack so that it can be pulled within the sack. When the two ends of the string 14 are pulled while holding the sack, the string constricts the opening of the sack making it smaller and effecting a closure of the sack. The string is thus a drawstring for closing the mouth of the sack. The string can be tied into a knot to prevent it from loosening. The string can also be sewn to the sack so that when the string is pulled it pulls a portion of the sack with it and causes a closure of the sack. When the string is attached to the sack only one end may be pulled to effect closure of the sack.

Figure 6:
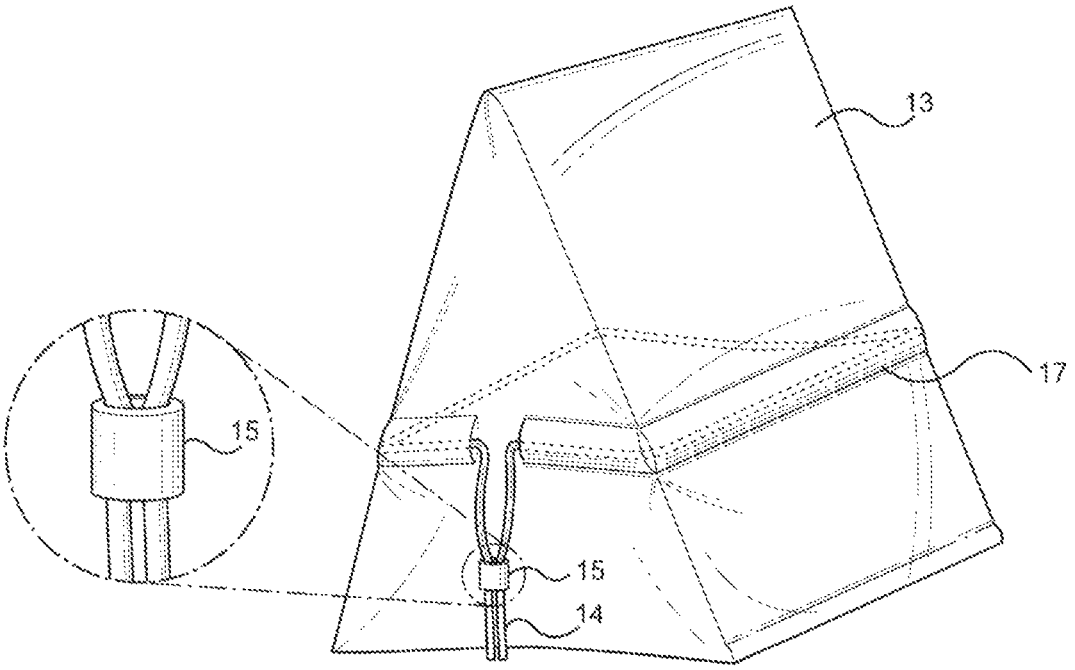
FIG. 6 is a perspective view of a pinched bottom sack made of ordinary paper with a drawstring around its side having a locking collar.

FIG. 6 shows a pinched bottom sack 13 with a string 14 running along a periphery of the sack. The string is enclosed inside a tubular enclosure, channels or loops, 17 which is part of the sack so that the string is free to move inside the enclosure. The two ends of the string pass through a hole in collar 15 made, preferably of cardboard or other recyclable material. The hole in collar 15 being barely big enough to contain the two lengths of string within it, constricts the two lengths of the string within the collar and prevents the string from loosening. The collar thus allows the length of string within the sack to form a noose which when tightened by pulling the free ends of the string through the collar while holding the collar or the sack, constricts the opening of the sack and forms a closure of the sack. The collar thus performs the same function as the knot in the string as described in FIG. 5 above serving as an adjustable knot that can moved up or down along the string to tighten or loosen the sack.

Figure 7:
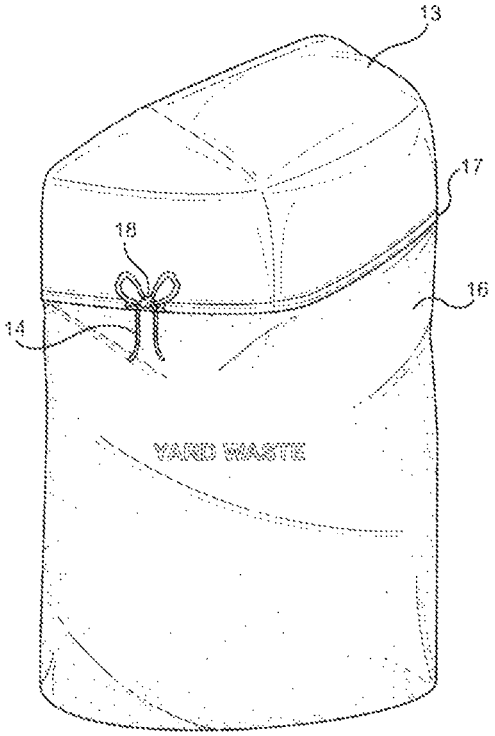
FIG. 7 is a perspective view of a yard waste sack that has been closed with a pinched bottom sack made of ordinary paper having a drawstring that has been tied in a knot.

FIG. 7 shows a sack 16 which may be a yard waste sack or shopping bag. A pinched bottom sack 13 with a string 14 permitting its closure has been used to close off the opening of the sack 16. The string 14 is enclosed inside a tubular enclosure, loop, or channel 17 which is part of sack 16. By pulling the sack 13 over a sack 16 which is full of yard waste, goods or other material and thus has a substantially cylindrical shape, the sack 13 can be secured around the sack 16 by pulling string 14 to tighten the sack 13 around the sides of sack 16. The sting 14 can then be secured from loosening by tying it in a knot 18.

Figure 8:
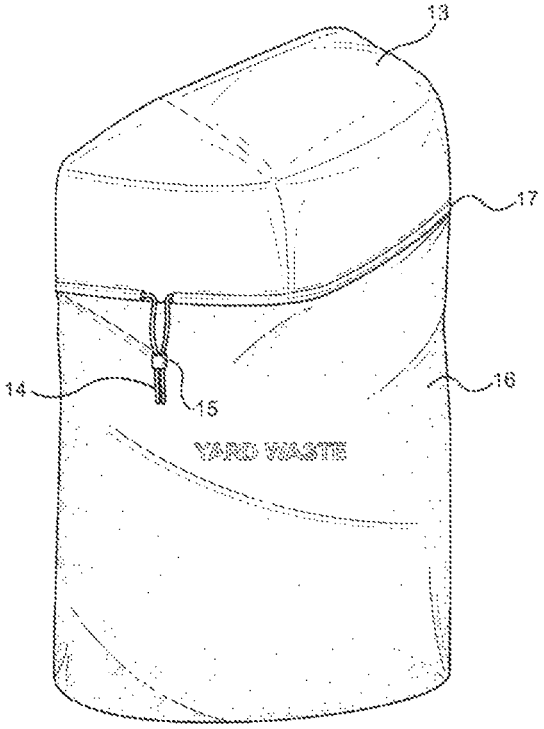
FIG. 8 is a perspective view of a Yard waste sack made of ordinary paper with a drawstring around its opening closed with a locking collar.

FIG. 8 shows a second sack 16 whose opening has been covered with a pinched bottom sack 13 having a tubular enclosure, loop, or channel 17 along the periphery of its opening. A string 14 passes through the enclosure 17 and secures the sack 13 around sack 16 by means of the collar 15 previously described in FIG. 6. The string can also be constrained from loosening by any number of mechanisms used in Industry for the purpose including being pinched by a cam within a housing or being pinched by a spring loaded cam or other member. The Clothing and sailing industries in particular have many such mechanisms serving this purpose.

Figure 9:
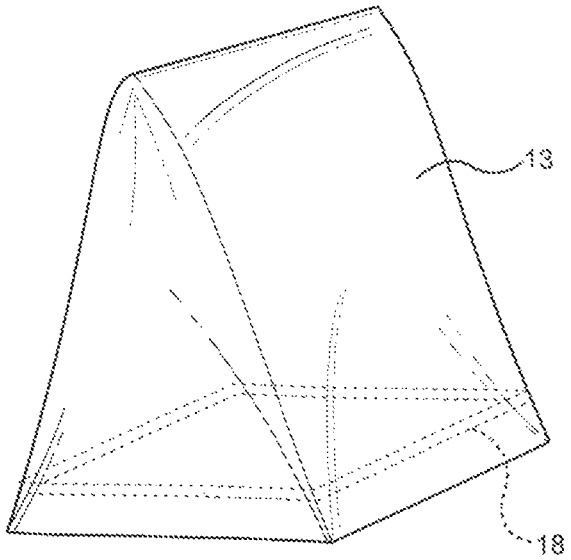
FIG. 9 is a perspective view of a pinched bottom sack made of ordinary paper with an elastic member attached around its opening.

FIG. 9 shows a pinched bottom sack made of paper e.g. Kraft paper 13. An elastic element 18 is attached along the periphery of the opening of the sack and serves to constrict the opening of the pinched bottom sack around the sides of another sack when it is used to close off the opening of the other sack. The elastic element 18 can be made of rubber or other elastomers but is preferably made of a recyclable material like paper.

Figure 10:
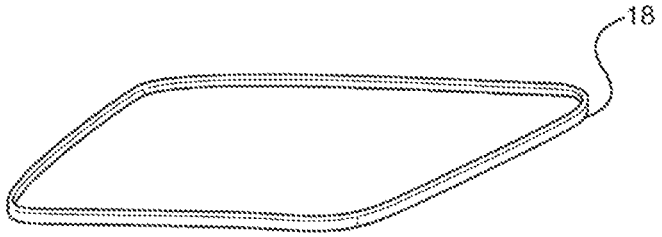
FIG. 10 is a perspective view of an elastic member.

FIG. 10 shows an elastic element 18 such as described in FIG. 9 above.

Figure 11:
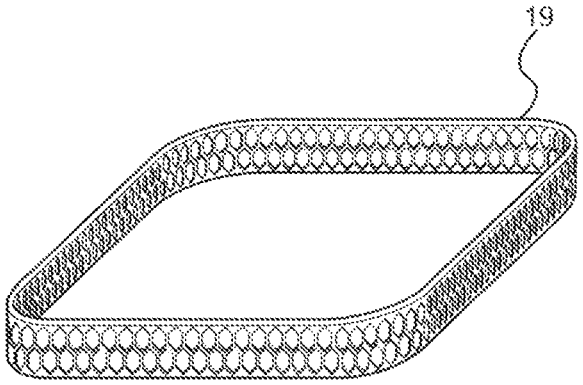
FIG. 11 is an elastic member for a sack made of expandable slitted paper.

FIG. 11 is an elastic element 19 that is made of Geami paper with slitted holes that expand into a hexagonal honeycomb structure when pulled causing the paper to stretch. The elastic element 19 can be made of a single layer of Geami paper or similar paper, or it could be comprised of two or more layers of this elastic paper. When attached along the periphery of a sack e.g. a pinched bottom sack as described in FIGS. 9 and 10 below, the Geami paper constricts the pinched bottom sack against another sack e.g. a yard waste sack to close off the sack. The Geami paper is recyclable so that a pinched bottom sack with an elastic Geami paper band is recyclable.

Figure 12:
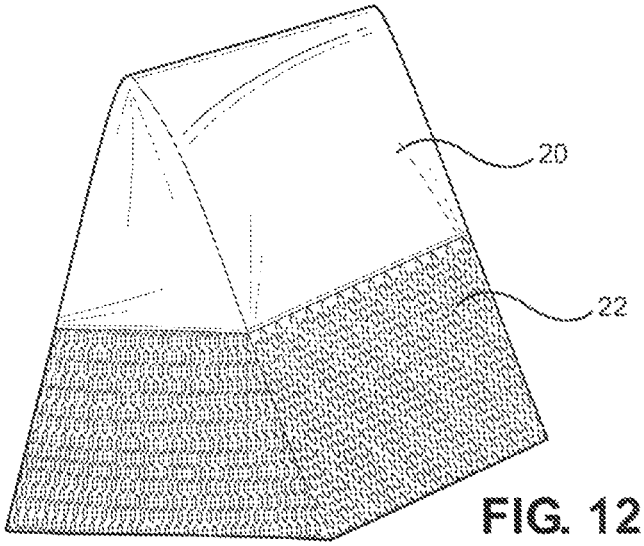
FIG. 12 is a perspective view of a pinched bottom sack made partly of ordinary paper and partly of slitted paper.

FIG. 12 shows another embodiment of a composite sack made of ordinary paper 20 and Geami paper 22. The top portion of the sack is a pinched bottom sack made of ordinary paper 20 like Kraft paper. The lower portion of the sack has a skirt of Geami paper 22 attached to it e.g. by gluing, sewing, stapling or any number of methods known to industry. Geami paper stretches when pulled, so that making a pinched bottom sack entirely out of Geami paper might require some specialized equipment and procedures. By making the part of the sack that requires the most handling e.g. pulling cutting and folding out or ordinary paper in a standard operation, and merely gluing a skirt of Geami paper to the ordinary sack, this composite sack can simplify the task of manufacturing an expanding paper sack. The upper portion of the sack made of ordinary paper 20 does not stretch when used to cover another sack but it defines the shape of the sack. A strip of Geami paper 22 glued to the edges of the pinched bottom sack 20 make it longer while providing it with an elastic skirt 22 that will stretch and press against the sides of another sack when used to cover the sack. The Geami paper skirt 22 can be made of one or more layers of Geami paper to increase the force of elasticity, i.e. the springiness of the paper is increased. A cover of this type can also be made from sheets of paper that are not fully covered in slits. Leaving areas of a sheet of paper without slits will accomplish the same effect as joining a skirt of paper with slits to a cover made of paper that does not have slits. This approach may provide some benefits in the manufacture of a cover by providing a paper that does not easily stretch in undesired areas due to the stiffness of the areas without slits.

Figure 13:
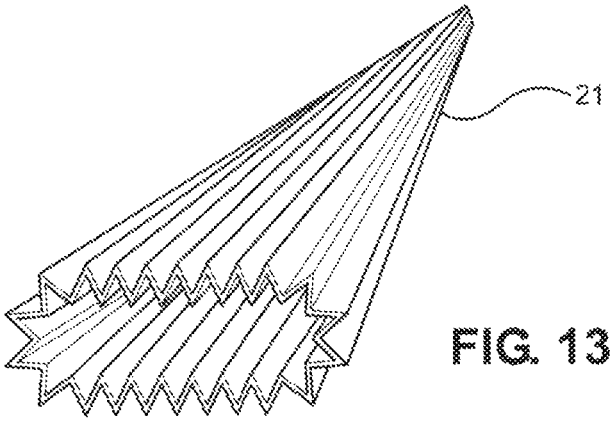
FIG. 13 is a perspective view of a pinched bottom sack made of pleated or corrugated paper.

FIG. 13 shows a paper sack made of pleated or corrugated paper 21. The pleats allow the paper sack to be made oversized and would have fit loosely on the sack, but the excess space is taken up by the pleats or corrugations. When a covering sack e.g. a pinched bottom sack is made in this way it will fit over the mouth of a sack being closed. The pleats will unfold and allow the sack to expand and accommodate the sack it is closing off. The elasticity of the paper will provide the elastic force needed to constrain the pinched bottom sack against the sides of the sack being closed.

Figure 14:
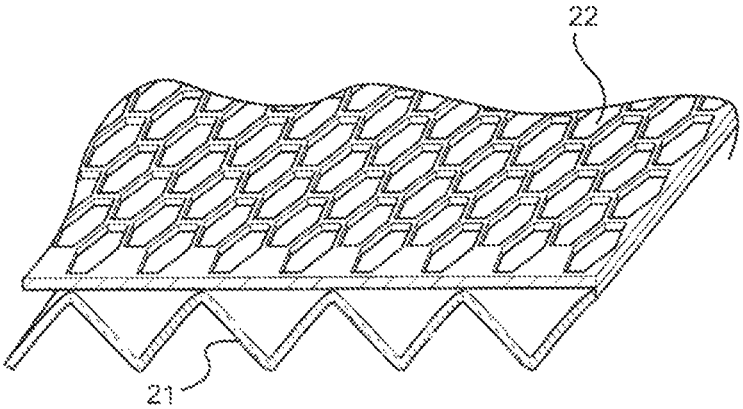
FIG. 14 is a section view of the wall of a sack made of pleated paper with an elastic member made of expandable slitted paper attached on one side.

FIG. 14 is a partial view of a section of the wall of a sack. It shows how the elasticity of a sack made of corrugated paper 21 can be increased. A layer of Geami paper is glued or otherwise attached to the corrugated walls 21 of a paper sack along a portion e.g. the peaks of the corrugations. When the sack is fitted over another sack to close the second sack off, the pleats or corrugations of the closing sack will unfold and allow the sack to expand. When this happens the Geami paper 22 will stretch, and because it is elastic it will increase the elastic force of the corrugated sack enabling the sack to grip tighter on the sack whose mouth is being closed. Without the addition of the Geami paper 22 the elasticity of a corrugated sack made of ordinary paper may be too small or weak to adequately grip a sack being closed off strongly enough to secure its contents from spilling when the sack is tipped over. In FIG. 14 the Geami paper is attached to one side of the sack.

Figure 15:
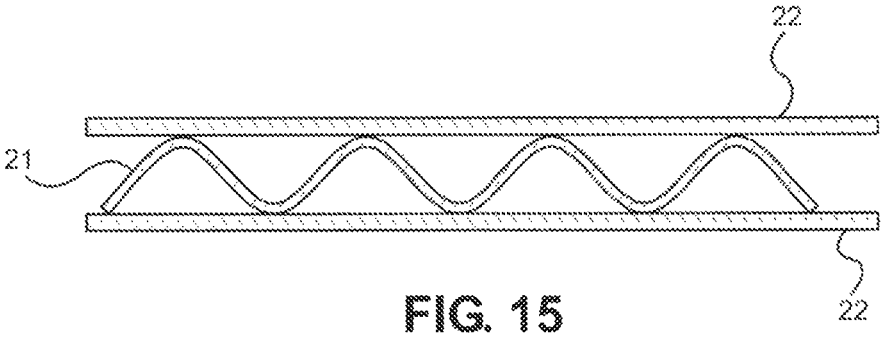
FIG. 15 is a section view of the wall of a sack made of pleated paper with an elastic member made of expandable slitted paper attached on both sides.

FIG. 15 shows a section view of a sack made of corrugated paper 21 as described above. This time the Geami paper 22 is attached on both sides of the corrugated paper walls. The double layer of Geami paper increases the elastic spring force of the walls of the sack over what would be possible with only a single layer of Geami paper thus increasing the force that a sack made of this type of material can grip the sides of a sack being closed off, thereby effecting a more secure closure of the sack.

Figure 16:
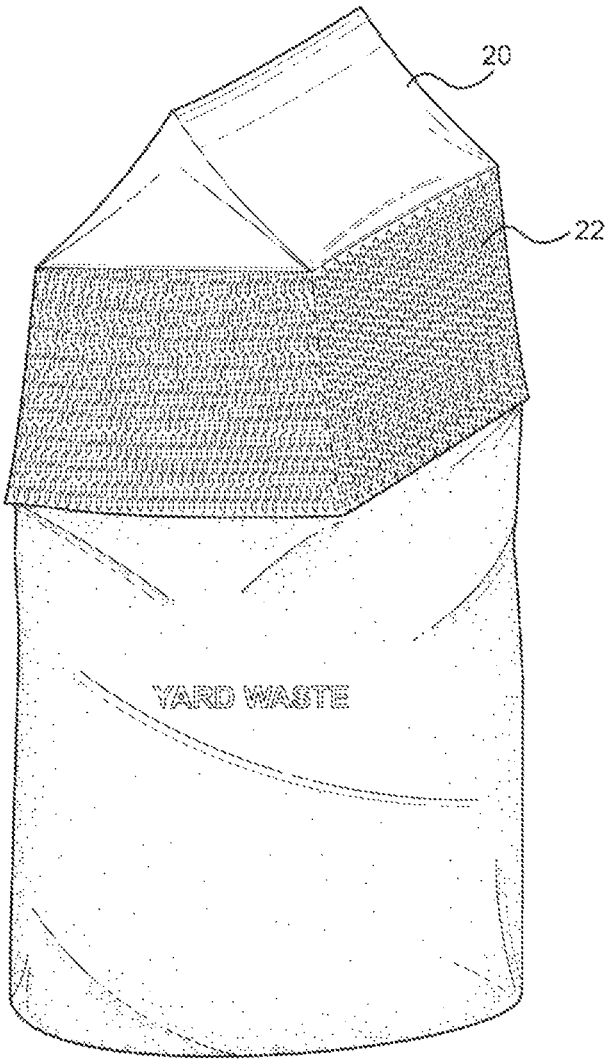
FIG. 16 is a perspective view of a yard waste sack closed with a pinched bottom sack made partly of ordinary paper and partly of slitted paper.

FIG. 16 shows the composite sack of FIG. 12 used to secure a yard waste sack. The gripping force is provided by the Geami paper 22. The shape of the Pinched bottom sack is defined by the upper part 20 which is made of ordinary paper e.g. Kraft paper.

Although the present invention has been described with reference to several embodiments, those skilled in the art will recognize that changes may be made in form and detail without departing from the scope of the invention.

I claim:

1. A cover for a sack with a closed end, an open end, and a cover body, which extends between the two ends, comprising:

expandable paper construction having an array of slit openings in the cover body in regular repeating patterns in the cover body in proximity to the open end;

the paper construction on the closed end having a bottom;

wherein the open end opens when an opening force pulls apart the perimeter edges of the open end of the cover which also makes the cover body grow into a larger three-dimensional structure;

wherein the cover is deployed over the sack at the open end; and wherein when the opening force is removed, the sides of the cover in proximity to the open end of the sack retract, grip the sack so that the cover forms an open end closure on the sack and prevents the contents of the sack from spilling from the open end closure of the sack and the cover body contracts, closing the slit openings as much as possible, the cover conforming approximately to the shape and dimensions of the sack as much as possible where it overlaps the sack.

2. The cover of claim 1, wherein the cover comprises one or more paper sheets with the cover body having a plurality of slit openings in a pattern of spaced parallel rows of individual slits.

3. The cover of claim 2, wherein in the un-expanded state of the paper the slit openings in the cover body are substantially closed and form parallel lines that extend in the direction of the open end to the closed end.

4. The cover of claim 2, wherein the slit openings in the cover body in each row are positioned adjacent to the interval spaces between consecutive slit openings in a next adjacent parallel row of slit openings.

5. The cover of claim 1, wherein the said slit openings are generally similar in shape and size, in a consistent, uniformly repeating pattern.

6. The cover of claim 1, wherein the slit openings after expansion are hexagonal.

7. The cover of claim 1, wherein the cover substantially regains its original shape and size when the opening force is removed.

8. The cover of claim 1, wherein the paper is die cut paper with slit openings that expands-into a hexagonal honeycomb structure when the cover body receives an opening force.

9. The cover of claim 1, wherein the cover is shaped into a pinched bottom sack with tapered sides ending in a ridge or line at the closed end.

10. The cover of claim 1, wherein the cover is formed into a bag with a rectangular bottom at the closed end.

11. The cover of claim 1 wherein portions of the cover in the vicinity of the closed end are made of ordinary paper, and the portions of the cover in proximity to its open end are made of expandable paper which has a plurality of arrayed openings that expand when the sides of the cover are pulled apart with an opening force and contract when the opening force is removed.

12. The cover of claim 1 wherein the cover is comprised substantially of corrugated or pleated paper, and an elastic member made of expandable paper which has a plurality of arrayed openings that expand when the sides of the cover are pulled open with the opening force and contract when the opening force is removed, is incorporated in the vicinity of the opening of the cover such that it allows the opening of the cover to expand when pulled apart with the opening force, and to contract when the opening force is removed.

13. A method of covering a sack with a cover comprising:

c) expanding the sides near the opening of a cover made with expandable and retractable paper having an array of slit openings formed into an enclosure with—an open end, a closed end, and a cover body which extends between the two ends, by subjecting the cover to an opening force that pulls apart the perimeter sides of the cover near the open end, and the cover body near the open end causing the slit openings to open wider, and the cover to get bigger;

d) applying the opening force to the cover so that its open end is larger than the sack, then positioning the open end of the cover over the open end of the sack;

c) removing the opening force on the perimeter sides of the cover near its open end, wherein-when the opening force is removed from the cover's open end, the cover retracts and grips the sides of the sack, so that the cover forms a closure of the sack and substantially prevents the contents of the sack from spilling, the cover body substantially conforming to the shape and dimensions of the sack where it overlaps the sack.

14. The method of claim 13, wherein the method comprises expanding the cover made of expandable paper with an opening force, where the majority of the slits of the paper are unopened and the slits form vertical lines running from the closed end to the open end; and just prior to deploying the cover over a sack, the sides of the cover in the vicinity of the open end of the cover are stretched by hand to cause a minimum number of slit openings in the vicinity of the open end to open and expand the opening of the cover, so that the cover can be positioned over a sack that is larger than the cover.

15. The method of claim 13 wherein the method comprises using an opening force on the perimeter sides of the open end of a cover made of flat or unexpanded paper, causing the cover opening to open just enough to fit the cover over the sack that it is covering.

* * * * *